US005399035A

United States Patent [19]

Nakae

[11] Patent Number: 5,399,035

[45] Date of Patent: Mar. 21, 1995

[54] INK RIBBON CASSETTE AND METHOD OF REPLACING INK RIBBON FILM

[75] Inventor: Nobuyuki Nakae, Tokyo, Japan

[73] Assignee: NEC Corporation, Tokyo, Japan

[21] Appl. No.: 227,896

[22] Filed: Apr. 15, 1994

Related U.S. Application Data

[63] Continuation of Ser. No. 73,883, Jun. 9, 1993, abandoned.

[30] Foreign Application Priority Data

Jun. 19, 1992 [JP] Japan ..... 4-160931

[51] Int. Cl.[6] ..... B41J 35/28

[52] U.S. Cl. ..... 400/207; 400/208

[58] Field of Search ..... 400/207, 208, 208.1

[56] References Cited

U.S. PATENT DOCUMENTS 4,160,605 7/1979 Neubaum ..... 400/208

FOREIGN PATENT DOCUMENTS 0358520 3/1990 European Pat. Off. ..... 400/208
0213180 9/1986 Japan ..... 400/208
0274971 12/1986 Japan ..... 400/207
0046668 2/1987 Japan ..... 400/208
2260516 9/1992 United Kingdom .

OTHER PUBLICATIONS

"Ribbon Cartridge", IBM Technical Disclosure Bulletin vol. 29, No. 12, May 1987.

"Colormate TM PS User's Guide", Mar. 1991, NEC Technologies, Inc., 1414 Massachusetts Avenue Boxborough, Mass. 01719, total 8 pages.

Abstract of "Japanese Office Printer Manual" (Disclosed in Nov., 1988), total 6 pages.

Abstract of "Catalog of Japanese Color Thermal Transfer Printer and User's Manual" (Disclosed in Dec., 1988), total 14 pages.

*Primary Examiner*—Edgar S. Burr
*Assistant Examiner*—Anthony H. Nguyen
*Attorney, Agent, or Firm*—Ostrolenk, Faber, Gerb & Soffen

[57] ABSTRACT

An ink ribbon cassette includes an ink ribbon unit, first and second housings, and coupling mechanisms, and holding mechanisms. The ink ribbon unit is replaced while an ink ribbon film is wound around a supply bobbin and a take-up bobbin. The first housing has a pair of first semi-cylindrical bobbin housing portions in which the supply and take-up bobbins of the ink ribbon unit are housed parallel to be spaced apart from each other at a predetermined interval. The second housing has a pair of second semi-cylindrical bobbin housing portions in which the supply and take-up bobbins are housed parallel to be spaced apart from each other at a predetermined interval. The coupling mechanisms couple the second housing to the first housing while the first bobbin housing portions are caused to correspond to the second bobbin housing portions, respectively. The holding mechanisms are arranged at two end portions of each of the first bobbin housing portions or each of the second bobbin housing portions, for detachably holding two end portions of the supply bobbin and those of the take-up bobbin. A method of replacing an ink ribbon film is also disclosed.

15 Claims, 2 Drawing Sheets

INK RIBBON CASSETTE AND METHOD OF REPLACING INK RIBBON FILM

This is a Continuation of application Ser. No. 08/073,883, filed on Jun. 9, 1993, now abandoned.

BACKGROUND OF THE INVENTION

The present invention relates to the housing structure of an ink ribbon cassette used for a recording apparatus such as a thermal printer, and a method of replacing an ink ribbon film.

In order to allow a user to replace an ink ribbon film used for a thermal transfer line printer or the like, good operability is required. For this reason, in a conventional ink ribbon film replacing method, an ink ribbon film is generally replaced as an expendable supply together with its ink ribbon cassette housing.

Disposing an ink ribbon film as an expendable supply together with its ink ribbon cassette in this manner leads to an increase in the expenses of expendable supplies on the user side, besides it is not desirable from the viewpoint of saving of resources and prevention of environmental pollution. Therefore, it is strongly required that large resin components such as ink ribbon cassette housings be reused.

In order to meet such a requirement, there is proposed a method of directly mounting a bobbin having an ink ribbon film wound therearound in a printer apparatus or the like. According to this method, however, a cumbersome operation is required, and hence a problem is posed in terms of the above-mentioned operability.

SUMMARY OF THE INVENTION

It is an object of the present invention to provide an ink ribbon cassette which facilitates replacement of an ink ribbon film in the ink ribbon cassette, and a method of replacing an ink ribbon film.

It is another object of the present invention to provide an ink ribbon cassette which allows a reduction in the expenses of expendable supplies on the user side, and a method of replacing an ink ribbon film.

It is still another object of the present invention to provide an ink ribbon cassette which allows saving of resources and prevention of environmental pollution, and a method of replacing an ink ribbon film.

In order to achieve the above objects, according to the present invention, there is provided an ink ribbon cassette comprising an ink ribbon unit to be replaced while an ink ribbon film is wound around a supply bobbin and a take-up bobbin, a first housing having a pair of first semi-cylindrical bobbin housing portions in which the supply and take-up bobbins of the ink ribbon unit are housed parallel to be spaced apart from each other at a predetermined interval, a second housing having a pair of second semi-cylindrical bobbin housing portions in which the supply and take-up bobbins are housed parallel to be spaced apart from each other at a predetermined interval, coupling mechanisms for coupling the second housing to the first housing while the first bobbin housing portions are caused to correspond to the second bobbin housing portions, respectively, and holding mechanisms, arranged at two end portions of each of the first bobbin housing portions or each of the second bobbin housing portions, for detachably holding two end portions of the supply bobbin and those of the take-up bobbin.

In addition, according to the present invention, there is provided a method of replacing an ink ribbon film, comprising the steps of separating an ink ribbon cassette into first and second housings, the first housing holding a used ink ribbon unit having a used ink ribbon film wound around a supply bobbin and a take-up bobbin, removing the used ink ribbon unit by disengaging the supply bobbin and the take-up bobbin, each having two end portions detachably held, from bobbin holding portions of the first housing, pushing the first housing into a face box containing a new ink ribbon unit having an unused ink ribbon film to cause two end portions of the supply bobbins and those of the take-up bobbins of the new ink ribbon unit to be held by the bobbin holding portions of the first housing, and coupling the second housing to the first housing holding the new ink ribbon unit.

DESCRIPTION OF THE PREFERRED EMBODIMENT

Figure 1A:
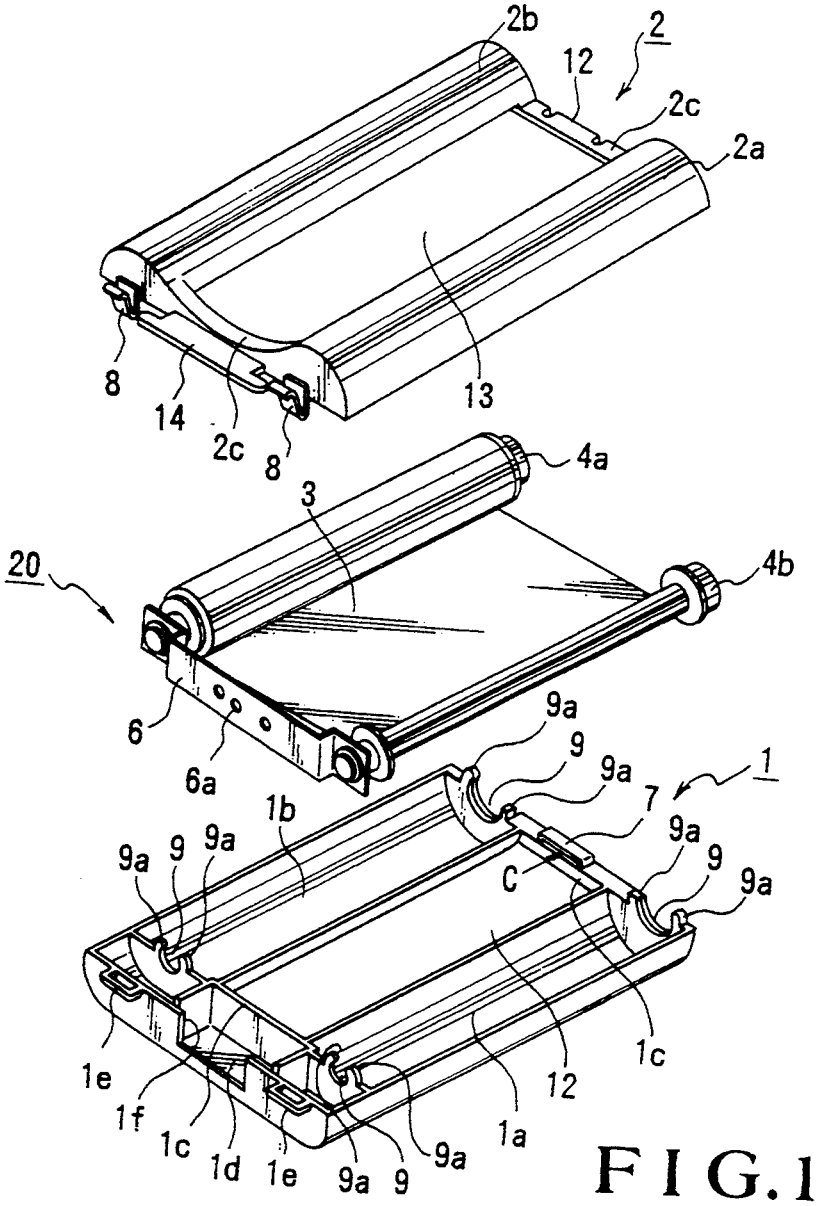
FIG. 1A is an exploded perspective view showing an ink ribbon cassette according to an embodiment of the present invention.
Figure 1B:
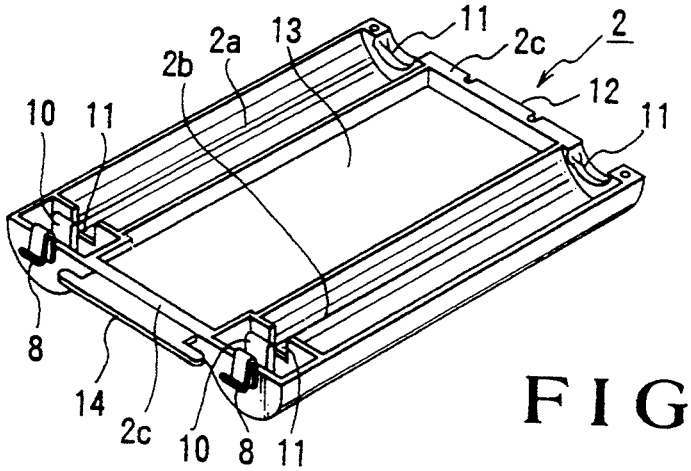
FIG. 1B is a perspective view showing an upper housing in a reversed state.
Figure 2:
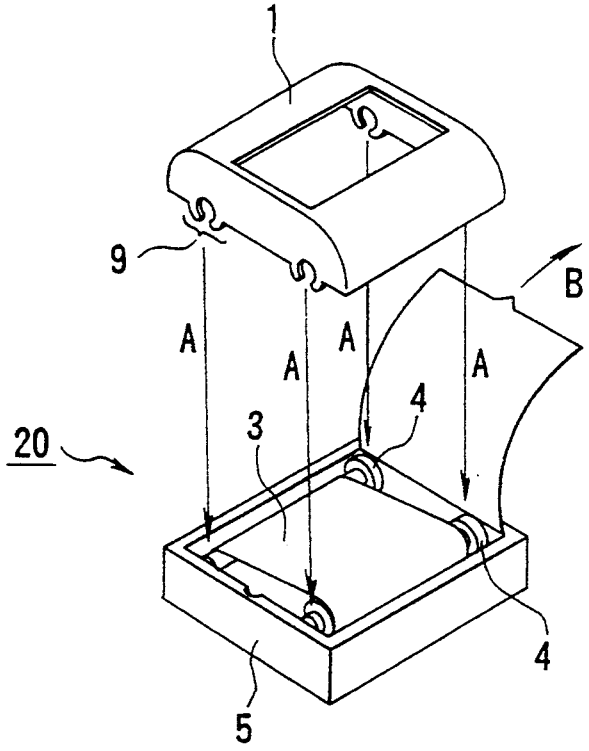
FIG. 2 is a perspective view for explaining a method of mounting an ink ribbon film.

The present invention will be described below in detail with reference to the accompanying drawings. FIG. 1A shows an ink ribbon cassette according to an embodiment of the present invention. FIG. 1B shows an upside-down ink ribbon cassette housing. FIG. 2 shows a method of mounting an ink ribbon film. Referring to FIGS. 1A and 1B, the ink ribbon cassette housing (to be referred to as a cassette housing hereinafter) is designed such that an ink ribbon cassette lower housing (to be referred to as a lower housing hereinafter) 1 can be separated/fitted from/to an ink ribbon cassette upper housing (to be referred to as an upper housing) 2. An ink ribbon unit 20 constituted by an ink ribbon cassette film 3, an ink ribbon film supply bobbin (to be referred to as a supply bobbin hereinafter) 4*a*, and an ink ribbon film take-up bobbin (to be referred to as a take-up bobbin hereinafter) 4*b* is housed between the lower and upper housings 1 and 2.

The lower housing 1 comprises two semi-cylindrical bobbin housing portions 1*a* and 1*b*, and a pair of frame members 1*c*. The supply and take-up bobbins 4*a* and 4*b* of the ink ribbon unit 20 are respectively housed in the bobbin housing portions 1*a* and 1*b*. The bobbin housing portions 1*a* and 1*b* are held parallel by the frame members 1*c* to be spaced from each other at a predetermined interval. The frame members 1*c* constitute a window 12. The two end portions of each of the bobbin housing portions 1*a* and 1*b* are notched into semicircular bobbin holding portions 9 having substantially the same diameter as the bobbin diameter so as to hold the two ends of the supply bobbin 4*a* and those of the take-up bobbin 4*b*. The two ends of the circumferential portion of each bobbin holding portion 9 are extended to form a pair of holding pawls 9*a*. In this case, both the supply bobbin 4*a* and the take-up bobbin 4*b* are designed such that the diameter on one end side is different from the diameter on the other end side. Moreover, an end portion of the supply bobbin 4a may have a different diameter than an end portion of the take-up bobbin 4b. The diameter of the semicircular notched portion of the bobbin holding portion 9 on one side is different from that of the bobbin holding portion 9 on the other side accordingly. A hook 7 to be engaged with a portion of the upper housing 2 is formed on the upper surface of the frame member 1c on one side. A ribbon type determining board 6 having ribbon type code holes 6a formed therein outside the two bobbin holding portions 9, and a housing portion 1d for housing a bobbin pressing spring 10 (to be described later) are formed at the frame member 1c on the other side, which member has a partition plate and a two-layer structure. In addition, a pair of fitting portions 1e protrude from the upper portion of the outer surface of the frame member 1c. A notched portion 1f is formed in the housing portion 1d to cause the code holes 6a of the ribbon type determining board 6 to oppose the outside of the lower housing 1.

The upper housing 2 is constituted by two bobbin housing portions 2a and 2b, and a pair of frame members 2c. The bobbin housing portions 2a and 2b house the supply and take-up bobbins 4a and 4b of the ink ribbon unit 20 in cooperation with the bobbin housing portions 1a and 1b of the lower housing 1. The bobbin housing portions 2a and 2b are held by the frame members 2c to be spaced apart from each other at a predetermined interval. The frame members 2c constitute a window 13. Notched portions 11 are formed in the two end portions of each of the bobbin housing portions 2a and 2b. The notched portions 11 serve to rotatably hold the two end portions of the supply bobbin 4a and those of the take-up bobbin 4b in cooperation with the holding pawls 9a of the lower housing 1. The outer portion of the frame member 2c on one side is notched to form an engaging portion 12 so as to be engaged with the hook 7 of the lower housing 1. A pair of bobbin pressing springs 10 are respectively housed in chambers outside the two notched portions 11 of the frame member 2c on the other side. Each of the bobbin pressing springs 10 acts on one end face of a corresponding one of the supply and take-up bobbins 4a and 4b to bias it in a predetermined direction. In addition, a pair of housing lock pawls 8 to be fitted in the fitting portions 1e of the lower housing 1 are formed on the outer surface, of the upper housing 2, located outside the bobbin pressing springs 10. Reference numeral 14 denotes a handle formed on the outer surface of the frame member 2c. The user holds the handle 14 when he/she separates the lower and upper housings 1 and 2 from each other.

An operation for replacing an ink ribbon film in the cassette housing having the above-described arrangement will be described next. First, a used cassette housing is removed from the printer apparatus. The user then depresses the housing lock pawls 8 to release the lock with the fitting portions 1e while holding the handle 14. Thereafter, the engaging portion 12 is disengaged from the hook 7. With this operation, the lower and upper housings 1 and 2 can be separated from each other. After the upper housing 2 is removed, the ink ribbon unit 20 is removed from the lower housing 1 by disengaging the two end portions of the supply bobbin 4a and those of the take-up bobbin 4b from the holding pawls 9a. The ink ribbon unit 20 is then disposed.

An operation for mounting a new ink ribbon unit 20 having an unused ink ribbon film 3 in the cassette housing will be described below with reference to FIG. 2. The ink ribbon unit 20 is independently housed in face box 5 while the ink ribbon cassette film 3 is wound around the supply bobbin 4a and the take-up bobbin 4b. First, an upper cover of the face box 5 is pulled in the direction indicated by an arrow B to allow the overall ink ribbon unit 20 to be seen. The lower housing 1, from which the used ink ribbon unit 20 has been removed, is positioned above the face box 5 in an open state, as indicated by arrows A. The two end portions of the supply bobbin 4a and those of the take-up bobbin 4b in the face box 5 are respectively pushed into the bobbin holding portions 9 of the lower housing 1 so as to be held by the holding pawls 9a. When the lower housing 1 is lifted from the face box 5 in this state, the ink ribbon unit 20 is removed from the face box 5 while it is held by the lower housing 1. With this operation, mounting of the ink ribbon unit 20 on the lower housing 1 is completed.

In this case, both the supply bobbin 4a and the take-up bobbin 4b are designed such that the two end portions have different diameters. If the user erroneously puts the lower housing 1 on the face box 5 in a laterally reversed state, the two end portions of the supply bobbin 4a and those of the take-up bobbin 4b cannot be properly pushed into the bobbin holding portions 9, thus preventing such an error in mounting. The two end portions of the supply bobbin 4a and those of the take-up bobbin 4b may have different diameters, respectively, to prevent an error in mounting when the ink ribbon film 3 of the ink ribbon unit 20 removed from the face box 5 is housed in a reversed state.

After mounting of the ink ribbon unit 20 in the lower housing 1 is completed, the engaging portion 12 of the upper housing 2 is engaged with the hook 7 of the lower housing 1, which is holding the ink ribbon unit 20, from the direction indicated by an arrow C in FIG. 1A. In addition, the housing lock pawls 8 of the upper housing 2 are fitted in the fitting portions 1e of the lower housing 1. With this operation, the cassette housing is locked while the new ink ribbon unit 20 is properly housed in the housing, thus completing replacement of the ink ribbon film 3 including the ink ribbon unit 20 and the ribbon type determining board 6.

As shown in FIG. 1, in the ink ribbon unit 20, the two ends of the ribbon type determining board 6 are respectively fixed to one end side of the supply bobbin 4a and that of the take-up bobbin 4b. With this structure, the distance between the two bobbins 4a and 4b is regulated, and play in the face box 5 and the housing cassette is restricted, thereby facilitating replacement of the ink ribbon unit 20.

Figure 3:
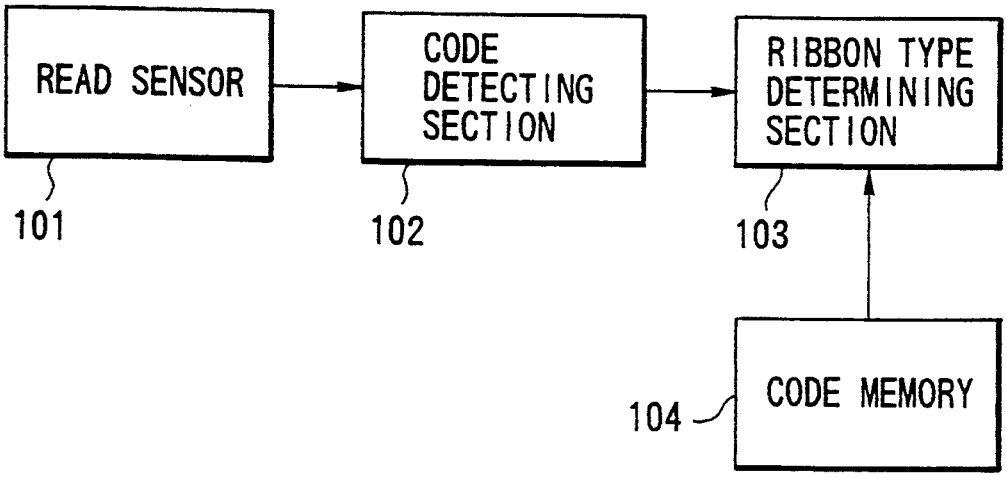
FIG. 3 is a block diagram showing a ribbon type determining unit.

FIG. 3 shows a ribbon type determining unit which is arranged in the printer main body to determine a type of ribbon by reading the code holes 6a of the ribbon type determining board 6. A read sensor 101 reads light reflected, at a predetermined position, by the ribbon type determining board 6 constituted by a reflecting plate through the notched portion 1f. A code detecting section 102 detects a 4-bit ribbon type code from the output from the read sensor 101. A ribbon type determining section 103 reads out and refers to the contents of a code memory 104 on the basis of the detected ribbon type code, thus determining the type of ribbon. With this operation, the printer apparatus automatically determines the type of new ink ribbon without a manual setting operation. In this embodiment, a ribbon type code is electrically detected by the read sensor 101. However, a ribbon type code may be mechanically detected.

As has been described above, according to the present invention, since only the ink ribbon unit in the ink ribbon cassette housing is replaced as an expendable supply, the quantities of expendable supplies can be reduced. In addition, the user can replace an ink ribbon film without directly touching the ribbon, thus improving operability in replacement. Furthermore, damage to an ink ribbon film and fingerprints thereon can be prevented, and hence replacement can be performed without influencing a print output. Moreover, since the ink ribbon cassette housing is reused, the expenses of expendable supplies can be reduced.

What is claimed is:

1. An ink ribbon cassette comprising:

an ink ribbon unit having a supply bobbin, a take-up bobbin and an ink ribbon film that is wound around said supply bobbin and said take-up bobbin, said supply bobbin having a first pair of circular end portions and said take-up bobbin having a second pair of circular end portions;

a first housing part having a pair of first semi-cylindrical bobbin housing portions, each of said first housing portions having two end portions, first portions of said supply and take-up bobbins being housed in said first pair of bobbin housing portions, respectively, such that said supply and take-up bobbins are parallel and spaced apart from each other at a predetermined interval;

a second housing part having a pair of second semi-cylindrical bobbin housing portions, each of said second housing portions having two end portions, second portions of said supply and take-up bobbins being housed in said second pair of bobbin housing portions, respectively, such that said supply and take-up bobbins are parallel and spaced apart from each other at said predetermined interval;

coupling mechanisms for coupling said second housing part to said first housing part so that said first pair of bobbin housing portions correspond with and are opposed to said second pair of bobbin housing portions, respectively;

respective holding mechanisms arranged at said two end portions of each of said first bobbin housing portions or at said two end portions of each of said second bobbin housing portions, said holding mechanisms detachably holding said first pair and second pair of end portions of said supply bobbin and said take-up bobbin, respectively;

each of said holding mechanisms including a bobbin holding portion, each of said bobbin holding portions including (i) a semicircular portion having substantially the same diameter as that of the corresponding end portion of said supply bobbin and said take-up bobbin; and (ii) a pair of extensions provided at two end portions of said semicircular portion, ends of said pair of extensions being spaced apart from each other to define a gap therebetween so that said corresponding end portion of said supply bobbin and said take-up bobbin can be inserted through said gap to be detachably held in the corresponding bobbin holding portion.

2. A cassette according to claim 1, wherein said first pair of end portions of said supply bobbin have different diameters and said second pair of end portions of said take-up bobbin have different diameters.

3. A cassette according to claim 2, wherein an end portion of said supply bobbin and an end portion of said take-up bobbin have different diameters.

4. A cassette according to claim 1, further comprising a ribbon type determining board for recording a code indicating a type of ink ribbon film.

5. A cassette according to claim 4, wherein said ribbon type determining board is fixed between one end of said supply bobbin and one end of said take-up bobbin to regulate the predetermined interval between said supply bobbin and said take-up bobbin.

6. A cassette according to claim 4, further comprising a notched portion in at least one of said first and second housing parts, said notched portion allowing the code on said ribbon type determining board to be outwardly opposed to an outside of said at least one housing part.

7. A cassette according to claim 1, further comprising a handle formed on at least one of said first and second housing parts.

8. A method of replacing an ink ribbon film, comprising the steps of:

separating an ink ribbon cassette into first and second housings, said first housing holding a used ink ribbon unit having a used ink ribbon film wound around a supply bobbin and a take-up bobbin;

removing the used ink ribbon unit by disengaging said supply bobbin and said take-up bobbin, each having two end portions detachably held, from bobbin holding portions of said first housing;

pushing said first housing into a face box containing a new ink ribbon unit having an unused ink ribbon film to cause two end portions of said supply bobbins and those of said take-up bobbins of said new ink ribbon unit to be held by said bobbin holding portions of said first housing; and coupling said second housing to said first housing holding said new ink ribbon unit.

9. A method according to claim 8, wherein each of said holding mechanisms is constituted by a bobbin holding portion formed by notching each of said bobbin housing portions in the form of a semicircle to have substantially the same diameter as that of a corresponding one of said two end portions of said supply bobbin and of said take-up bobbin, and a pair of extensions formed by extending two end portions of a circumferential portion of said bobbin holding portion.

10. A method according to claim 9, wherein said end portions of said supply bobbin have different diameters and said end portions of said take-up bobbin have different diameters, and each of said bobbin holding portions has a semicircular notched portion having a diameter corresponding to an end portion of a bobbin to be held.

11. A method according to claim 10, wherein an end portion of said supply bobbin and an end portion of said take-up bobbin have different diameters.

12. A method according to claim 8, further comprising the step of fixing a ribbon type determining board on which a code indicating a type of ink ribbon film is recorded between one end of said supply bobbin and one end of said take-up bobbin.

13. A method according to claim 12, further comprising the step of replacing said ribbon type determining board together with said ink ribbon unit.

14. A method according to claim 12, further comprising the step of providing a notched portion in at least one of said first and second housings.

15. A method according to claim 8, wherein the step of separating said ink ribbon cassette into said first and second housings comprises the step of holding a handle formed on at least one of said first and second housings when said two housings are separated from each other.

* * * * *